United States Patent [19]

Osako et al.

[11] 3,966,853

[45] June 29, 1976

[54] PROCESS FOR PREPARING PRILLED POROUS AMMONIUM NITRATE

[75] Inventors: Naoto Osako; Katsumi Kozima; Hiroshi Shimizu; Kazumi Kimura, all of Kitakyushu, Japan

[73] Assignee: Mitsubishi Chemical Industries Ltd., Tokyo, Japan

[22] Filed: Sept. 25, 1974

[21] Appl. No.: 509,257

[30] Foreign Application Priority Data

Sept. 25, 1973 Japan ..... 48-107712

[52] U.S. Cl. ..... 264/13; 149/46; 264/DIG. 51; 264/14

[51] Int. Cl.[2] ..... B01J 2/04

[58] Field of Search ..... 264/13, DIG. 51, 14, 264/3 R, 3 C, 3 D; 149/7, 46, 47

[56] References Cited

UNITED STATES PATENTS

| | | | |
|---|---|---|---|
| 2,382,298 | 8/1945 | Datin | 264/14 |
| 2,887,724 | 5/1959 | Bettes, Jr. | 264/14 |
| 3,127,249 | 3/1964 | Cuthbert | 264/13 |

*Primary Examiner*—Robert F. White
*Assistant Examiner*—J. R. Hall
*Attorney, Agent, or Firm*—Oblon, Fisher, Spivak, McClelland & Maier

[57] ABSTRACT

A prilled ammonium nitrate containing 2 to 5 percent by weight water obtained by prilling an aqueous solution of 93 to 98 percent by weight ammonium nitrate is dried by: lowering the drying temperature of the ammonium nitrate to a temperature less than the III—IV crystalline transition temperature of ammonium nitrate at least once when the water content of the prilled ammonium nitrate is 0.3 to 1.5 percent by weight in the drying step; further drying at a temperature higher than the III—IV transition temperature; and adding an anti-caking agent to the dried prilled ammonium nitrate. The dried, prilled ammonium nitrate obtained is useful as an ammonium nitrate fuel oil explosive.

8 Claims, 1 Drawing Figure

WATER CONTENT IN AMMONIUM NITRATE (%, by weight)
4.0
3.5
3.0
2.5
2.0
1.5
1.0
0.5
0
0
5
10
15
20
25
30
DRYING TIME (minutes)
1
2

PROCESS FOR PREPARING PRILLED POROUS AMMONIUM NITRATE

BACKGROUND OF THE INVENTION

1. Field of the Invention

The present invention relates to a process for preparing prilled porous ammonium nitrate. More particularly, the present invention relates to an industrially advantageous process for preparing prilled porous ammonium nitrate which has excellent properties as an ammonium nitrate fuel oil explosive (hereinafter abbreviated as "ANFO explosive").

2. Description of the Prior Art

The prilled ammonium nitrate which is used for ANFO explosives and which is different from the prilled ammonium nitrate used for fertilizers must have various properties such that it has high fuel oil absorption. The high fuel oil absorption properties greatly improve the blasting power of ANFO explosives. The prilled nitrate should have an appropriate hardness of 15 to 40 percent so that it does not cake nor powder during handling such as packaging, transportation or the like. However, it should be capable of being powdered under appropriate conditions so that it can be mechanically charged in high density as an ANFO explosive.

In one industrial process for preparing prilled ammonium nitrate for ANFO explosives ammonium nitrate is prilled by spraying an aqueous ammonium nitrate solution of 93 to 98 percent by weight at an elevated temperature of 135° to 160°C from the top of a prilling tower, collecting the prilled ammonium nitrate containing 2 to 6 percent by weight water at the bottom of the tower and further drying it at 90° to 110°C to a water content usually below 0.5 percent by weight, preferably below 0.3 percent. However, it is extremely difficult to carry out the drying step effectively because fine crystals of ammonium nitrate mass on the surface of the prilled ammonium nitrate to form a shell which hinders evaporation of the water present within the particles.

In one method of obtaining a prilled ammonium nitrate which is porous and as high fuel oil absorption properties or which prevents the caking of prilled ammonium nitrate during storage by removing the water content therefrom, a method of utilizing the cracks formed in the ammonium nitrate particles by the transitions of the ammonium nitrate crystal phases has been proposed, for example U.S. Pat. No. 2,382,298 and Japanese Pat. No. 22375/1966. That is, ammonium nitrate possesses the crystalline phases, I, II, III, IV and V and the transition temperatures therebetween are usually as described below. In each transition volume changes occur upon shrinking and expansion which crack the surfaces of the prilled ammonium nitrate particles.

| Shrinking | Expansion | Shrinking | Expansion |
|---|---|---|---|
| I ⇄ | II ⇄ | III ⇄ | IV ⇄ V |
| Expansion (125°C) | Shrinking (85°C) | Expansion (32°C) | Shrinking (−18°C) |

The method employed in the above mentioned U.S. Pat. No. 2,382,298 involves a rapid quench of prilled ammonium nitrate obtained by prilling a concentrated ammonium nitrate solution containing 4 to 6 percent by weight water to a temperature less than 32°C (III ⇄ IV transition point, at this point the water content of the prilled ammonium nitrate is 3.0 to 5.5 percent by weight) and subsequently raising the temperature to about 100°C to dry the prilled ammonium nitrate. The above mentioned U.S. Patent discloses that prilled ammonium nitrate containing 4 percent by weight water can have its water content lowered to 0.3 percent by weight after quenching by drying it in hot air for 50 minutes. In other words the method involves cracking the surface of prilled ammonium nitrate by raising and lowering the temperature thereof up and down at the III ⇄ IV transition point (32°C) thereby prompting the removal of water in the particles.

Also the method of Japanese Pat. No. 22375/66 involves cracking the surface of prilled ammonium nitrate by cooling to a temperature less than 32°C and then reheating the cooled material which removes water and simultaneously renders the nitrate particles porous. However, the ammonium nitrate particles obtained by these methods are not only so soft that they are unsuitable for ANFO explosives, but they also are defective in that they cake during handling in packaging and transportation. Other techniques have been proposed for preventing the caking of prilled ammonium nitrate, such as by adding various organic substances as anti-caking agents, because the more complete the prevention of caking, the more difficult it becomes to remove water from ammonium nitrate. However, when an organic substance is added to the ammonium nitrate, it becomes discolored, deteriorates or changes pH since the amount of organic substance added must be large because it is not sufficiently dispersed. Therefore, in order to prevent the caking of ammonium nitrate to such a degree that the defects do not occur and so that only small amounts of organic substance are used, the organic substance needs to be uniformly dispersed in the ammonium nitrate particles. This is usually accomplished by spraying an aqueous solution containing the substance onto the ammonium nitrate before drying the ammonium nitrate. On the other hand, when the prilled ammonium nitrate is dried, powdered dust is unavoidably generated and the yield is usually lowered to 85 to 90 percent. In order to improve the yield, the powdered dust generated in the drying step is recirculated to the ammonium nitrate solution to be prilled for reuse. However, when an organic substance is added to the ammonium nitrate solution before drying as described above, if powdered dust as it is generated is recirculated to the prilling step, the organic substance is exposed to high temperatures such as, for example, 180°C in the prilling tower and stands in danger of exploding since the organic substance is concentrated several times in the powdered dust generated. Therefore, the recovered powdered dust is usually of no use except as raw materials for cheap compounds or mixed fertilizers and thus the method has the extreme disadvantage of being very uneconomical.

A need, therefore, continues to exist for a method of economically prilling ammonium nitrate such that it is sufficient for use in ANFO explosives.

SUMMARY OF THE INVENTION

Accordingly, one object of the present invention is to provide a process for preparing a prilled porous ammonium nitrate which has a low water content, improved anti-caking properties and of a hardness preferred for explosives by drying ammonium nitrate without adding a drying aid in the drying step and diminishing the amount of powdered dust generated in the drying step.

Briefly, this object and other objects of the present invention as hereinafter will become more readily apparent can be attained in the case of a prilled porous ammonium nitrate obtained by drying prilled ammonium nitrate containing 2 to 5 percent by weight water obtained by prilling an aqueous solution containing 93 to 98 percent by weight ammonium nitrate, by: (a) lowering the temperature of ammonium nitrate during drying to a temperature less than the III—IV crystalline transition temperature of ammonium nitrate at least once when the water content of the prilled ammonium nitrate becomes 0.3 to 1.5 percent by weight; (b) further drying at a temperature higher than the III—IV transition temperature; and (c) adding an anti-caking agent to the dried prilled ammonium nitrate.

BRIEF EXPLANATION OF THE DRAWINGS

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE PREFERRED EMBODIMENTS

Figure 1:
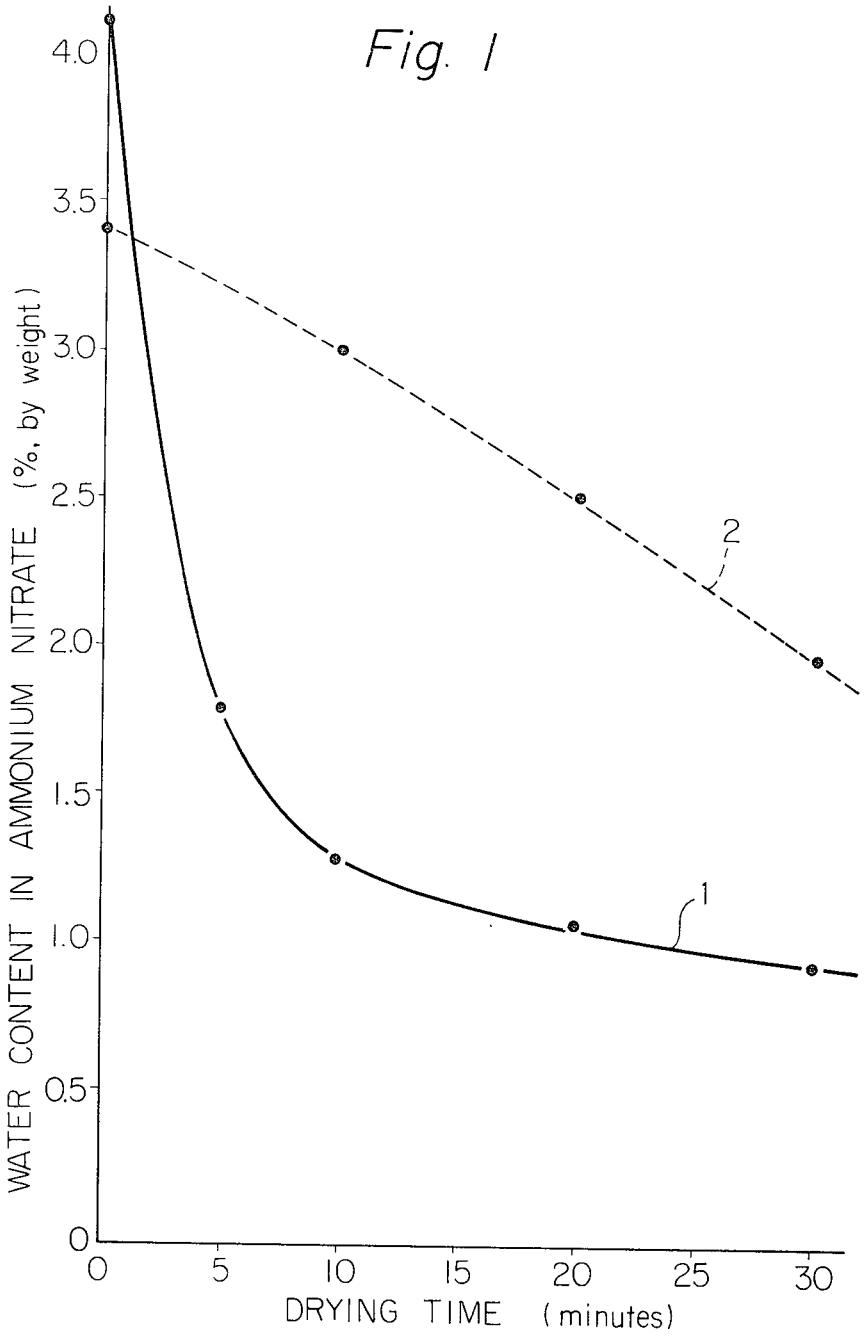
FIG. 1 is a graph showing the relationship between the drying time and water content of ammonium nitrate particles at a drying temperature of 60°C.

The liquid ammonium nitrate supplied to the prilling step in the present process is an aqueous ammonium nitrate solution of 93 to 98 percent by weight preferably 94 to 97 percent by weight ammonium nitrate. If the concentration is outside of this range, a product having appropriate hardness and porosity cannot be obtained. The prilling is conducted by a known method, such as by spraying liquid ammonium nitrate of an appropriate concentration at a temperature of 135° to 180°C from the top of a prilling tower 20 to 60 m in height to obtain prilled ammonium nitrate containing 2 to 5 percent by weight water at a temperature of 50° to 110°C at the bottom of the tower.

In the present invention, the prilled ammonium nitrate thus obtained is dried to prepare prilled porous ammonium nitrate. It is necessary to lower the temperature of the ammonium nitrate particles to a temperature lower than the III—IV crystalline transition temperature of ammonium nitrate at least once at the time when the water content of the prilled ammonium nitrate comes into the range of 0.3 to 1.5 percent by weight in the drying step. In a good method of drying prilled ammonium nitrate, a prilled ammonium nitrate containing 2 to 5 percent by weight water is first dried to 0.4 to 3 percent, preferably 0.6 to 1.5 percent by weight water at a temperature in the III crystalline phase (32° to 85°C). In this drying step it is necessary to dry the prilled ammonium nitrate until the water content decreases to 0.4 to 3 percent by weight, preferably 0.6 to 1.5 percent by weight, at a drying temperature of usually 32° to 85°C, preferably 40° to 85°C. If the drying temperature is too low, the prilled ammonium nitrate does not have sufficient porosity and its oil absorption properties are poor since the saturation solubility is decreased and the porosity is reduced. The drying time is usually 5 to 60 minutes although it varies with the kind of drying apparatus and the water content of the ammonium nitrate at the time of drying. A drying apparatus such as a fluidized bed dryer, turbodryer, rotary kiln, or the like can be used in this drying. When the fluidized bed dryer is used, it is preferable to add 0.3 to 2.5 percent by weight, preferably 0.8 to 1.5 percent by weight, water to the prilled ammonium nitrate of 2 to 5 percent by weight water and age it before drying, because it is not only useful for preventing the prilled ammonium nitrate from pulverizing and for regulating the hardness, but also makes control of the water content in the prilled ammonium nitrate easier. And in this case, after water is added, it is preferably maintained for 1 to 20 minutes, desirably 3 to 15 minutes before drying.

FIG. 1 is a graph showing the relationship between the drying time and the water content of ammonium nitrate particles when dried in a fluidized bed dryer (drying temperature is 60°C), wherein Curve 1 shows the case in which the particles are dried after moistening with water and curve 2 shows the case in which the particles are dried without moistening. From the graph it can be appreciated that, in the case of Curve 1, the drying rate is greater and the water content of the prilled ammonium nitrate can be more easily controlled since it becomes nearly constant at about 1.0 percent, by weight.

In the present invention, it is necessary to hold the prilled ammonium nitrate at a temperature less than the III—IV crystalline transition point of ammonium nitrate at least once at the time when the water content becomes 0.3 to 1.5 percent by weight, preferably 0.3 to 1.2 percent by weight. This operation can be performed, for example, by contacting the prilled ammonium nitrate with cold air, or holding it in a container provided with an external cooling means. Preferably, the cooling is conducted by using a cold flowing gas in a fluidized bed dryer. Thereafter, the prilled ammonium nitrate is heated to a temperature higher than the III—IV crystalline transition point and dried. The drying temperature is usually 40° to 110°C, preferably 50° to 95°C. The drying step is conducted until the water content of the prilled ammonium nitrate is below 0.1 percent. A fluidized bed dryer or turbodryer is preferably used in the drying step.

The amount of powdered dust generated in the above drying step is extremely small, and the dust can be circulated into a prilling tower since a drying accelerator is not present in the ammonium nitrate. The caking properties of the prilled porous ammonium nitrate obtained by the process of this invention are less than those of the prilled porous ammonium nitrate obtained by any other method. Nevertheless, in the present invention, an anti-caking agent is added thereto to improve the caking properties even more.

Straight chain aliphatic mono-amines and/or salts thereof are particularly preferable as anti-caking agents although various kinds of substances may be used. Generally amines having an alkyl group of more than 12 carbon atoms, preferably more than 14 to 22 carbon atoms, are used. For example, suitable amines include tetradecylamine, hexadecylamine, octadecylamine, and the like as well as the acetate, formate, lactate, propionate, sulfate, phosphate, hydrochloride salts and the higher fatty acid salts, and the like of the amines. Most preferable are the higher fatty acid salts. Suitable higher fatty acid salts include straight chain aliphatic monoamines which are obtained by reacting a higher fatty acid having 7 to 22 carbon atoms such as heptanoic acid, octanoic acid, decanoic acid, dodecanoic acid, hexadecanoic acid, octadecanoic acid, docosanoic acid or the like with a straight chain aliphatic monoamine in amounts of 0.5 to 1.0 mole, preferably 0.75 to 1.0 mole of the fatty acid per mole of the monoamine by mixing and stirring the components at a temperature of 40° to 130°C, preferably 60° to 100°C, at least above the melting point of the mixture for 5 to 30 minutes. When the above mentioned reaction is conducted in the presence of a small amount of acid at a $pK_1$ below 5 (logarithm value of the reciprocal of acid dissociation constant) such as sulfuric acid, phosphoric acid, hydrochloric acid, formic acid, butyric acid or the like, the salt obtained has excellent anti-caking properties. In this case the mole ratio of the amine, the higher fatty acid and the acid with a $pK_1$ below 5 is usually 1.0 : 0.25 to 0.90 : 0.05 – 0.50. In these cases the acid with a $pK_1$ below 5 is used in amounts of 0.5 to 1.0 mole per one mole of higher fatty acid, and the total number of mole of acid with a $pK_1$ below 5 and the higher fatty acid is 0.75 to 1.0 per one mole of the amine are particularly preferred. Also three or more of the above mentioned amines and/or salts thereof can be preferably mixed to improve the sensitivity of the ammonium nitrate explosive. The resulting composition must meet the following requirements:

1. The weight ratio of an amine present in the maximum quantity to the other amines present in the second quantity is 10 : 1 to 1 : 1, preferably 5 : 1 to 1 : 1.

2. When three kinds of amines are used the amount of each amine in the minimum quantity is above 7 percent by weight, preferably above 10 percent by weight, based on the total amount of amines when more than four kinds of amines are used; the amount of each amine present in the minimum quantity is above 2 percent by weight, based on the total amount of amines.

In the present invention, magnesium stearate, calcium stearate, magnesium aluminate silicate, ethylene-bis-stearamide, and the like, which are used conventionally as anti-caking agents may be used alone or in combination. Particularly, a combination with magnesium stearate is preferable for its anti-caking effect. In the present invention excellent anti-caking effects are obtained by selecting an appropriate anti-caking agent as described above. Also, when adding an anti-caking agent as described above to the dried porous ammonium nitrate obtained according to the present process, explosives using the ammonium nitrate have very high explosion velocities.

The amount of anti-caking agent which is used is usually within the range of 0.01 to 1.0 percent, preferably 0.05 to 0.5 percent based on the weight of ammonium nitrate. When the amount is too small, sufficient effects are not obtained. If the amount used is too large, it is not only economically disadvantageous, but also brings about changes of pH and coloring of the ammonium nitrate. The addition of anti-caking agent to the prilled porous ammonium nitrate is conducted, for example, by spraying an anti-caking agent dissolved in water or in an organic solvent or melted by heating onto ammonium nitrate particles and treated by drying ordinarily at 40° to 100°C in a rotary drum or container provided with a stirrer while rotating. When the anti-caking agent is solid, it may be added in the form of a powder.

When an aqueous solution of an anti-caking agent is added by the above described method, about 2 percent by weight of water sticks onto the dried surface of the prilled ammonium nitrate. The particles must be dried after addition of the anti-caking agent. Furthermore, when the anti-caking agent is added as a powder, the adherence of the powder to the ammonium nitrate is improved by using the powder together with a viscous substance such as liquid paraffin.

The prilled porous ammonium nitrate obtained as described above is not in danger of caking during storage because of the substantially improved caking properties, and has an improved hardness of 15 to 40 percent so that it is excellent as an ammonium nitrate for ANFO explosives. Also, in the manufacturing process, hardly any powdered dust is generated and, even if a small amount of dust is generated, it can be circulated into a prilling tower for reuse because a drying aid is not contained therein. Therefore, the process of the present invention results not only in improved manufacturing yield, but also there are no public nuisance problems involved in the manufacturing steps.

Having generally described the invention, a further understanding can be obtained by reference to certain specific examples which are provided herein for purpose of illustration only and are not intended to be limiting unless otherwise specified.

EXAMPLE 1

A 3000 g amount of prilled ammonium nitrate particles with a diameter greater than 0.42 mm (moisture content—3.2%, average particle diameter—1.3 mm, temperature—72°C) prepared by spraying an ammonium nitrate solution containing 95 percent ammonium nitrate from the top of a prilling tower, was introduced into a fluid bed cooler, where a cooling gas was passed into the bed at a linear velocity of 1.5 m/s (this rate was maintained throughout the cooling). (In the following examples as well as the Control examples, the weight of prilled ammonium nitrate is expressed based on prilled ammonium nitrate particles having a diameter greater than 0.42 mm unless otherwise stated). After cooling for 5 minutes, the temperature of the ammonium nitrate dropped to 35°C and the moisture content decreased to 2.7 percent. Cooling was continued further. After 25 minutes, 2816 g of prilled ammonium nitrate having a moisture content of 1.0 percent and a temperature of 26°C were obtained. Cooling was then stopped, and fluid drying by a hot gas was continued for 30 minutes at the linear velocity of 1.5 m/s and a temperature of 80°C to yield 2782 g of prilled ammonium nitrate having a moisture content of 0.3 percent.

The latter product was then introduced into a fluid bed cooler and was subjected to fluid cooling by a cooling gas which was passed into the bed at the linear velocity of 1.5 m/s for 25 minutes to yield 2775 g of prilled ammonium nitrate having a temperature of 26°C. The resulting prilled ammonium nitrate had a moisture content of 0.10 percent, a hardness of 23 percent and a pore volume of 0.14 cc/g. The final yield of prilled ammonium nitrate was 95.5 percent.

Alternatively, prilled ammonium nitrate having a moisture content of 0.3 percent prepared in the course of the foregoing process was introduced into a rotating drum immediately after drying, and octadecylamine heated at 70°C was added by spraying in amounts of 0.1 percent based on the prilled ammonium nitrate. Cooling gas was then introduced again into the fluid bed cooler at a linear velocity of 1.5 m/s for 15 minutes to effect fluid cooling to 26°C. The resulting prilled ammonium nitrate had a moisture content of 0.1 percent.

Ammonium nitrate particles with a diameter less than 0.42 mm produced in the cooling step after the addition of octadecylamine, containing less than 0.2 percent octadecyl amine, amounted to less than 0.2 percent of the treated ammonium nitrate. The prilled ammonium nitrate thus obtained had a caking strength of 0.84 Kg/cm$^2$.

CONTROL EXAMPLE 1

A 3,000 g amount of prilled ammonium nitrate particles having a diameter greater than 0.42 mm (moisture content—4.1%, average diameter—1.3 mm, temperature of ammonium nitrate—64°C) prepared by spraying an ammonium nitrate solution containing 94 percent ammonium nitrate from the top of a prilling tower were introduced into a fluid bed cooler, and cooled to 28°C by cooling gas at a linear velocity of 1.5 m/s for 5 minutes. There resulted 2,850 g of prilled ammonium nitrate having a moisture content of 3.1%. Next a hot gas was passed into the bed at a linear velocity of 1.5 m/s and at 90°C for 30 minutes for fluid drying, to yield 1,843 g of prilled ammonium nitrate having a moisture content of 0.6 percent. The cooling gas was again passed into the bed at a linear velocity of 1.5 m/s to cool to 26°C. There resulted 1618 g of prilled ammonium nitrate having a moisture content of 0.4 percent, a hardness of 66 percent, a caking strength greater than 5 Kg/cm$^2$, and a pore volume of 0.35 cc/g. The final yield of prilled ammonium nitrate was 56 percent.

EXAMPLE 2

A 3000 g amount of prilled ammonium nitrate immediately after prilling as in Example 1 was dried by use of a fluid bed drier at a linear velocity of 1.5 m/s at 70°C for 30 minutes to yield 2778 g of prilled ammonium nitrate with a moisture content of 1.2 percent. Next the fluidizing gas was changed to a cooling gas. Ammonium nitrate was cooled to 25°C by passing the cooling gas through the bed at a linear velocity of 1.5 m/s for 15 minutes. There resulted 2751 g of prilled ammonium nitrate with a moisture content of 0.7%. The latter prilled ammonium nitrate was subjected to fluid drying at 80°C for 20 minutes (linear velocity: 1.5 m/s) to give 2732 g of prilled ammonium nitrate with a moisture content of 0.21 percent. The last prilled ammonium nitrate was subjected to fluid cooling at 26°C (linear velocity: 1.5 m/s) to give 2728 g of prilled ammonium nitrate having a moisture content of 0.10%, a hardness of 24% and a pore volume of 0.23 cc/g. The final yield of prilled ammonium nitrate was 94%.

The prilled ammonium nitrate having a moisture content of 0.1 percent after cooling obtained above was introduced into a rotating drum and octadecylamine formate was added by spraying in amounts of 0.1 percent based on the prilled ammonium nitrate. There resulted prilled ammonium nitrate having a moisture content of 0.11 percent and a caking strength of 0.66 Kg/cm$^2$. As was expected, addition of an anti-caking agent eliminated ammonium nitrate particles of a diameter less than 0.42 mm almost completely.

EXAMPLE 3

A 3000 g amount of prilled ammonium nitrate immediately after prilling as in Example 1 was added with 1 percent by weight of water by spraying, subjected to aging at 70°C for 5 minutes, and then dried at 60°C at a linear velocity of 1.5 m/s for 10 minutes by use of a fluid bed drier to yield 2840 g of prilled ammonium nitrate having a moisture content of 1.4 percent by weight. The fluidizing gas was then changed to a cooling gas to cool the ammonium nitrate for 10 minutes at a linear velocity of 1.5 m/s to 25°C. There resulted 2799 g of prilled ammonium nitrate having a moisture content of 0.9 percent, by weight. The latter prilled ammonium nitrate was subjected to fluid drying at 80°C for 20 minutes (linear velocity—1.5 m/s) and then to fluid cooling at 26°C (linear velocity—1.5 m/s) to yield 2771 g of prilled ammonium nitrate having a moisture content of 0.11 percent by weight. The prilled ammonium nitrate obtained thus had a hardness of 32 percent and a pore volume of 0.24 cc/g. The final yield of prilled ammonium nitrate was 95% by weight.

The prilled ammonium nitrate having a moisture content of 0.11 percent by weight, after drying, as obtained in the above step, was introduced in a rotating drum, and octadecylamine acetate was added in amounts of 0.1 % based on the prilled ammonium nitrate. There resulted prilled ammonium nitrate having a moisture content of 0.1 percent by weight, and a caking strength of 0.64 Kg/cm$^2$. As a matter of fact, addition of the anti-caking agent eliminated ammonium nitrate particles having a diameter less than 0.42 mm almost completely.

EXAMPLE 4

In the process of Example 1, octadecylamine was replaced by a mixed salt of octadecylamine, octadecanoic acid and sulfuric acid prepared by process a, and by octadecylamine octadecanoate prepared by process b to be described later. After one of these agents was added to the prilled ammonium nitrate in amounts of 0.1 percent, cooling was effected as in Example 1 to yield prilled ammonium nitrate having a moisture content of 0.1 percent. The resulting prilled ammonium nitrate had a caking strength of 0.18 Kg/cm$^2$ when the salt according to process was used, and 0.24 Kg/cm$^2$ when the salt according to process b was used.

PROCESS *a*

A 134.5 g amount of octadecylamine (manufactured by Kao Soap Co., Ltd., containing 66% octadecylamine, 30% hexadecylamine and 4% tetradecylamine) dissolved at 70°C was added slowly to 106.5 g of octadecanoic acid with stirring until perfectly dissolved. To the resulting mixture was added 12.5 g of 98% sulfuric acid by slow addition. The mixture was then stirred for about 10 minutes and left to cool and solidify. The resulting product was ground to particles of sizes less than 100 mesh. The product thus obtained was named anti-caking agent *a*.

PROCESS *b*

A 134.5 g amount of octadecylamine (manufactured by Kao Soap Co., Ltd., containing octadecylamine, 30% hexadecylamine and 4% tetradecylamine) dissolved at 70°C was mixed slowly with 142 g of octadecanoic acid with stirring, and held in the dissolved state with stirring for 10 minutes to produce a mixture of octadecylamine and octadecanoic acid. The mixture was solidified after cooling freely and ground to particles of size less than 100 mesh. The resulting product was named anti-caking agent *b*.

EXAMPLE 5

The formate of octadecylamine used in the process of Example 2 was replaced by a salt mixture of octadecylamine, octadecanoic acid and sulfuric acid, and the octadecanoate of octadecylamine prepared by process *a* and *b* respectively described in Example 4. One of these anti-caking agents was added to prilled ammonium nitrate in amounts of 0.1 percent. The resulting prilled ammonium nitrate had a caking strength of 0.19 $Kg/cm^2$ when the salt according to process *a* was used, and 0.25 $Kg/cm^2$ when the salt according to process *b* was used.

When the acetate of octadecylamine used in Example 3 was replaced by the mixed salt of octadecylamine, octadecanoic acid and sulfuric acid, and the octadecanoate of octadecylamine prepared according to process *a* and *b* respectively described in Example 4 and added to the prilled ammonium nitrate, the resulting product was found to have a caking strength of 0.20 $Kg/cm^2$ when the salt according to process *a* was used, and 0.26 $Kg/cm^2$ when the salt according to process *b* was used.

CONTROL EXAMPLE 2

A 3000 g amount of prilled ammonium nitrate immediately after prilling as in Example 1 was treated by spraying with 4 percent solution of octadecylamine nitrate in amount of 0.1 percent based on the ammonium nitrate. The resulting mixture was subjected to fluid drying at a linear velocity of 1.5 m/s and at 80°C for 30 minutes in a fluid bed drier to yield 2632 g of prilled ammonium nitrate having a moisture content of 0.15 percent and about 270 g of ammonium nitrate containing 0.2 percent octadecylamine and having a particle size less than 0.42 mm. The prilled ammonium nitrate of particle size greater than 0.42 mm was cooled by passing a cooling gas through the particles at a linear velocity of 1.5 m/s at 25°C for 15 minutes to yield 2617 g of prilled ammonium nitrate having a moisture content of 0.10 percent. The prilled ammonium nitrate thus obtained had a hardness of 11 percent, a caking strength of 4.7 $Kg/cm^2$, and a pore volume of 0.18 cc/g. The final yield of prilled ammonium nitrate was 90 percent.

In order to promote drying and to prevent caking, $RNH_2$ was added before the final drying. As a consequence, the concentrated $RNH_2$ was mixed into the dust, and because of the flying $RNH_2$, the caking characteristics of the prilled nitrate particles were worse than when $RNH_2$ was added after the final drying as in Example 4.

CONTROL EXAMPLE 3

One of the following anti-caking agents was substituted for octadecylamine formate in Example 2 and was added to ammonium nitrate in an amount of 0.1 percent by weight with the following results.

| Anticaking agent | Moisture content, % | Hardness, % | Caking-strength ($Kg/cm^2$) | Pore Volume (cc/g) |
|---|---|---|---|---|
| Magnesium stearate | 0.10 | 22 | 3.7 | 0.23 |

-continued

| Anticaking agent | Moisture content, % | Hardness, % | Caking-strength ($Kg/cm^2$) | Pore Volume (cc/g) |
|---|---|---|---|---|
| Aluminum stearate | 0.11 | 24 | 4.2 | 0.23 |
| $Al_2O_3 \cdot MgO \cdot 2SiO_2 \cdot 4H_2O$ (Magnesium silicate-aluminate) | 0.11 | 24 | 2.6 | 0.22 |
| Ethylene bis-stearamide | 0.10 | 22 | 3.6 | 0.23 |

EXAMPLE 6

Prilled ammonium nitrate having a moisture content of 0.1 percent by weight, prepared in Example 1 was added to a 3 percent by weight aqueous solution of nitrate salts of the following alkyl amine mixture such that the amine to ammonium nitrate ratio by weight was 0.001.

| | |
|---|---|
| Primary aliphatic alkyl amine having a $C_{16}$ - alkyl group | 17% |
| Primary aliphatic alkyl amine having a $C_{18}$ - alkyl group | 39% |
| Primary aliphatic alkyl amine having a $C_{20}$ alkyl group | 3% |
| Primary aliphatic alkyl amine having a $C_{22}$ - alkyl group | 41% |

Fluid drying of the treated particles in air at 70°C gave prilled ammonium nitrate having a moisture content of 0.09%. The latter prilled ammonium nitrate was impregnated with light oil of secondary class at the rate of 6% based on ammonium nitrate and subjected to Test B for Priming Sensitivity by the Japanese Industrial Standards Test K4826 — 1968 to determine the priming sensitivity thereof. The results of the measurements are shown in Table 1.

EXAMPLE 7

To prilled ammonium nitrate having a moisture content of 0.1% by weight, prepared in Example 2 was added a 5% solution of the formate salts of the following alkyl amine mixture by spraying the amine salts onto the nitrate particles such that the amine to ammonium nitrate ratio by weight was 0.001. The resulting material was subjected to fluid drying in air at 80°C to yield prilled ammonium nitrate having a moisture content of 0.08%. As in Example 6, the priming sensitivity thereof was measured. The results are shown in Table 1.

| | |
|---|---|
| Primary aliphatic alkyl amine having a $C_{10}$ - alkyl group | 11% |
| Primary aliphatic alkyl amine having a $C_{12}$ - alkyl group | 52% |
| Primary aliphatic alkyl amine having a $C_{14}$ - alkyl group | 22% |
| Primary aliphatic alkyl amine having a $C_{16}$ - alkyl group | 10% |
| Primary aliphatic alkyl amine having a $C_{18}$ - alkyl group | 5% |

EXAMPLE 8

To prilled ammonium nitrate having a moisture content of 0.1% by weight prepared in Example 2 was added by spraying an aqueous solution containing 4% by weight of the formate salts of the alkyl amine mixture below in amounts of 0.1% by weight. The resulting material was subjected to fluid drying at 80°C to produce prilled ammonium nitrate having a moisture content of 0.05%, by weight. As in Example 6, the priming sensitivity thereof was determined. The results are shown in Table 1.

| | |
|---|---|
| Primary aliphatic alkyl amine having a $C_6$ - alkyl group | 10% |
| Primary aliphatic alkyl amine having a $C_8$ - alkyl group | 5% |
| Primary aliphatic alkyl amine having a $C_{10}$ - alkyl group | 5% |
| Primary aliphatic alkyl amine having a $C_{12}$ - alkyl group | 47% |
| Primary aliphatic alkyl amine having a $C_{14}$ - alkyl group | 17% |
| Primary aliphatic alkyl amine having a $C_{16}$ - alkyl group | 9% |
| Primary aliphatic alkyl amine having a $C_{18}$ - alkyl group | 7% |

CONTROL EXAMPLE 4

The prilled ammonium nitrate having a moisture content of 0.1% by weight, prepared in Example 2 was subjected to the test for priming sensitivity as in Example 6 without the addition of an alkylamine. The results are shown in Table 1.

CONTROL EXAMPLE 5

To prilled ammonium nitrate having a moisture content of 0.1% by weight prepared in Example 1 was added by spraying a 3% solution of the nitrate salts of the alkyl amine mixture below such that the amine to ammonium nitrate ratio was 0.001 by weight to yield prilled ammonium nitrate having a moisture content of 0.08% by weight. As in Example 6, the priming sensitivity thereof was measured. The results are shown in Table 1.

| | |
|---|---|
| Primary aliphatic alkyl amine having a $C_{16}$ - alkyl group | 1% |
| Primary aliphatic alkyl amine having a $C_{18}$ - alkyl group | 7% |
| Primary aliphatic alkyl amine having a $C_{20}$ - alkyl group | 5% |
| Primary aliphatic alkyl amine having a $C_{22}$ - alkyl group | 87% |

CONTROL EXAMPLE 6

To prilled ammonium nitrate having a moisture content of 0.1% by weight prepared in Example 1 was added by spraying a 3% aqueous solution of the nitrate salts of the alkyl amine mixture below such that the amine to ammonium nitrate ratio was 0.001 by weight to yield prilled ammonium nitrate having a moisture content of 0.09% by weight, and a pore volume of 0.16 cc/g. As in Example 6, the priming sensitivity thereof was measured. The results are shown in Table 1.

| | |
|---|---|
| Primary aliphatic alkyl amine having a $C_{14}$ - alkyl group | 4% |
| Primary aliphatic alkyl amine having a $C_{16}$ - alkyl group | 30% |
| Primary aliphatic alkyl amine having a $C_{18}$ - alkyl group | 66% |

TABLE 1

| Sample | Moisture % | Pore Volume cc/g | Priming Sensitivity | | | |
|---|---|---|---|---|---|---|
| | | | Blasting Cap 1 | 2 | 3 | 4 |
| Example 6 | 0.09 | 0.14 | 0/3 | 3/3 | 3/3 | — |
| Example 7 | 0.08 | 0.23 | 3/3 | 3/3 | — | — |
| Example 8 | 0.05 | 0.23 | 3/3 | 3/3 | — | — |
| Control 4 | 0.11 | 0.23 | — | — | — | 0/3 |
| Control 5 | 0.08 | 0.14 | — | 0/3 | 1/3 | 3/3 |
| Control 6 | 0.09 | 0.14 | — | 0/3 | 3/3 | 3/3 |

Priming sensitivity is represented by a fraction where the numerator represents the number of primings and the denominator the number of measurements.

The hardness, caking strength and pore volume of prilled ammonium nitrate in the examples as well as the control examples were determined in the following way.

Hardness: A 50 g amount of ammonium nitrate particles with sizes in the range of 10.5 – 14 mesh were placed into a cylindrical stainless steel vessel having a diameter of 20 cm and a length of 1.5 cm. A circular plate with a diameter of 18.5 cm and a weight of 1.5 Kg was placed upon the vessel and rotated 5 times in 10 seconds. Thereafter, the ammonium nitrate was sifted through a 14 mesh sieve.

Hardness is defined as the quotient expressed in percentages of the weight of ammonium nitrate below the sieve divided by 50 g.

Caking strength: A sample of ammonium nitrate was placed into a cylinder of vinyl chloride measuring 75 mm × 100 mm, covered by a bag of polyethylene under a load of 10 Kg, and kept in a thermo-hygrostat of 60% humidity. The temperature of ammonium nitrate was varied to achieve one cycle as 20°C → 40°C → 20°C in about 7 hours, whereby the ammonium nitrate passed through two phase transitions. The ammonium nitrate was then removed from the cylinder, and subjected to a breaking test by a breaking resistance measuring instrument, Tensilon Type UTM III (made by Toyo Sokki Co.) to determine the breaking strength. The breaking strength thus obtained was expressed as caking strength.

The pore volume of the prilled ammonium nitrate was determined by the combined use of an apparatus made by AMINCO Co. (U.S.A.) and the method in which mercury is pressed into the particles of the ammonium nitrate.

Having now fully described this invention, it will be apparent to one of ordinary skill in the art that many changes and modifications can be made thereto without departing from the spirit or scope of the invention as set forth herein.

What is claimed as new and intended to be secured by letters patent is:

1. In a process for preparing dried, prilled porous ammonium nitrate by prilling an aqueous solution of 93% to 98% by weight ammonium nitrate, whereby a prilled ammonium nitrate product is obtained containing 2% to 5% water, and thereafter drying said prilled ammonium nitrate, the improvement comprising:

a. drying said prilled ammonium nitrate containing 2% to 5% water under conditions such that the drying temperature is eventually lowered to a temperature less than the III—IV crystalline transition temperature of ammonium nitrate at least once when the water content of the prilled ammonium nitrate reaches the level of 0.3 to 1.5% by weight;

b. heating said dried ammonium nitrate further at a temperature higher than the III—IV transition temperature to complete drying of said ammonium nitrate; and c. adding an anti-caking agent to said dried ammonium nitrate, whereby a dry, porous, prilled ammonium nitrate product is obtained.

2. The process of claim 1, wherein said prilled ammonium nitrate in step (a) is dried at a temperature higher than said III—IV crystalline transition temperature until the water content is reduced by at least 0.5% by weight and becomes 0.4 to 3% by weight.

3. The process of claim 1, wherein the amount of anti-caking agent added is 0.01 to 1.0% by weight based on the ammonium nitrate.

4. The process of claim 1, wherein said anti-caking agent is selected from the group consisting of straight chain aliphatic monoamines, salts thereof and mixtures thereof.

5. The process of claim 1, wherein said anti-caking agent is a higher fatty acid salt of a straight chain aliphatic monoamine obtained by stirring a mixture of a straight chain aliphatic monoamine and a higher fatty acid in a mole ratio of 1 : 0.5 to 1.0 at a temperature of 40° to 130°C with the proviso that the temperature is higher than the melting point of the mixture.

6. The process of claim 1, wherein said anti-caking agent is a mixture of a higher fatty acid salt of a straight chain aliphatic monoamine and a salt of an acid with a $pK_1$ less than 5 which is obtained by stirring a mixture of a straight aliphatic monoamine, a higher fatty acid and acid with a $pK_1$ less than 5 in the mole ratio of 1 : 0.25 to 0.90 : 0.05 to 0.5 at a temperature of 10° to 130°C.

7. The process of claim 1, wherein said anti-caking agent is a mixture of at least three compounds selected from the group consisting of straight chain aliphatic monoamines, wherein each monoamine contains different alkyl groups, and salts thereof under conditions such that:

1. the weight ratio of the amine present in a maximum amount relative to the other amines present in lesser amounts is 10 : 1 – 1 : 1;
2. when a mixture of three amines is used, the amount of each amine present must be minimum amount of more than 7% by weight based on the total amount of amines; and
3. when more than four amines are used, the amount of each amine present must be a minimum quantity of more than 2% weight based on the total amount of amines.

8. The process of claim 2, which further comprises:

a. adding 0.3 to 2.5% by weight water to said prilled ammonium nitrate containing 2 % to 5% by weight water to moisten the same; and thereafter b. drying said moistened ammonium nitrate in a fluidized bed dryer as described in steps (a) and (b) of claim 9 to achieve a product containing 0.1% or less water.

* * * * *